US007499001B2

(12) United States Patent
Fujieda

(10) Patent No.: US 7,499,001 B2
(45) Date of Patent: Mar. 3, 2009

(54) DIELECTRIC ANTENNA DEVICE

(75) Inventor: Tomoyuki Fujieda, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/667,019

(22) PCT Filed: Oct. 7, 2005

(86) PCT No.: PCT/JP2005/018905

§ 371 (c)(1),
(2), (4) Date: Sep. 18, 2007

(87) PCT Pub. No.: WO2006/049002

PCT Pub. Date: May 11, 2006

(65) Prior Publication Data

US 2008/0036675 A1 Feb. 14, 2008

(30) Foreign Application Priority Data

Nov. 5, 2004 (JP) ..... 2004-321844

(51) Int. Cl.
*H01Q 15/08* (2006.01)

(52) U.S. Cl. ..... 343/911 L; 343/700 MS

(58) Field of Classification Search ..... 343/911 L
See application file for complete search history.

(56) References Cited

U.S. PATENT DOCUMENTS

| | | | | |
|---|---|---|---|---|
| 6,900,764 | B2 * | 5/2005 | Kingsley et al. | 343/700 MS |
| 6,940,463 | B2 * | 9/2005 | Ittipiboon et al. | 343/729 |
| 7,423,591 | B2 * | 9/2008 | Fox | 343/700 MS |
| 2008/0129616 | A1 * | 6/2008 | Li et al. | 343/713 |

FOREIGN PATENT DOCUMENTS

| | | |
|---|---|---|
| JP | 8-250926 | 9/1996 |
| JP | 10-501384 | 2/1998 |
| JP | 2001-345633 | 12/2001 |
| JP | 2002-135036 | 5/2002 |
| JP | 2002-261532 | 9/2002 |
| JP | 2003-513495 | 4/2003 |

* cited by examiner

*Primary Examiner*—Trinh V Dinh
(74) *Attorney, Agent, or Firm*—McGinn IP Law Group, PLLC

(57) ABSTRACT

The dielectric antenna device of the present invention is a dielectric antenna device having at least one feed element that is buried in a dielectric. The interval between the end portion of the feed element and the end face of the dielectric in a direction passing through the end portion of the feed element from a feeding point thereof is substantially 1/20 or more of the wavelength of a wireless signal that is formed within the dielectric. This constitution provides a dielectric antenna device that has stabilized resonance frequency.

7 Claims, 6 Drawing Sheets

DIELECTRIC ANTENNA DEVICE

TECHNICAL FIELD

The present invention relates to a dielectric antenna device having a dielectric for wavelength shortening.

BACKGROUND ART

Dielectric antenna devices in which a dielectric is disposed in the periphery of antenna wiring to reduce the size of the whole antenna device by utilizing the wavelength shortening effect are known. Array antenna devices that include a dielectric between a feed element for exciting a wireless signal therein and a parasitic element for guiding or reflecting the wireless signal are also known. Japanese Patent Application Kokai (Laid Open) No. 2002-135036 and Japanese Patent Application Kokai (Laid Open) No. 2002-261532 disclose a compact and directional antenna device which is implemented by combining these two types of antenna device.

DISCLOSURE OF THE INVENTION

Although the reduction of the antenna size is achieved by using a dielectric, there exists a problem that the resonance frequency is not constant due to fabrication tolerances and another problem that the resonance frequency fluctuates as a result of damage and/or defect through usage to the end of the antenna which has the dielectric.

The aforementioned problems are examples of the problems which the present invention intends to solve, and an object of the present invention is to provide a dielectric antenna device that achieves stabilization of the resonance frequency.

The dielectric antenna device of one aspect of the present invention has at least one feed element that is buried in a dielectric. The interval between the end portion of the feed element and the end face of the dielectric in the direction extending from a feeding point of the feed element toward the end portion of the feed element is approximately 1/20 or more of a wavelength of a wireless signal that is formed within the dielectric.

MODE FOR CARRYING OUT THE INVENTION

An embodiment of the present invention will now be described in detail with reference to the attached drawings.

Figure 1:
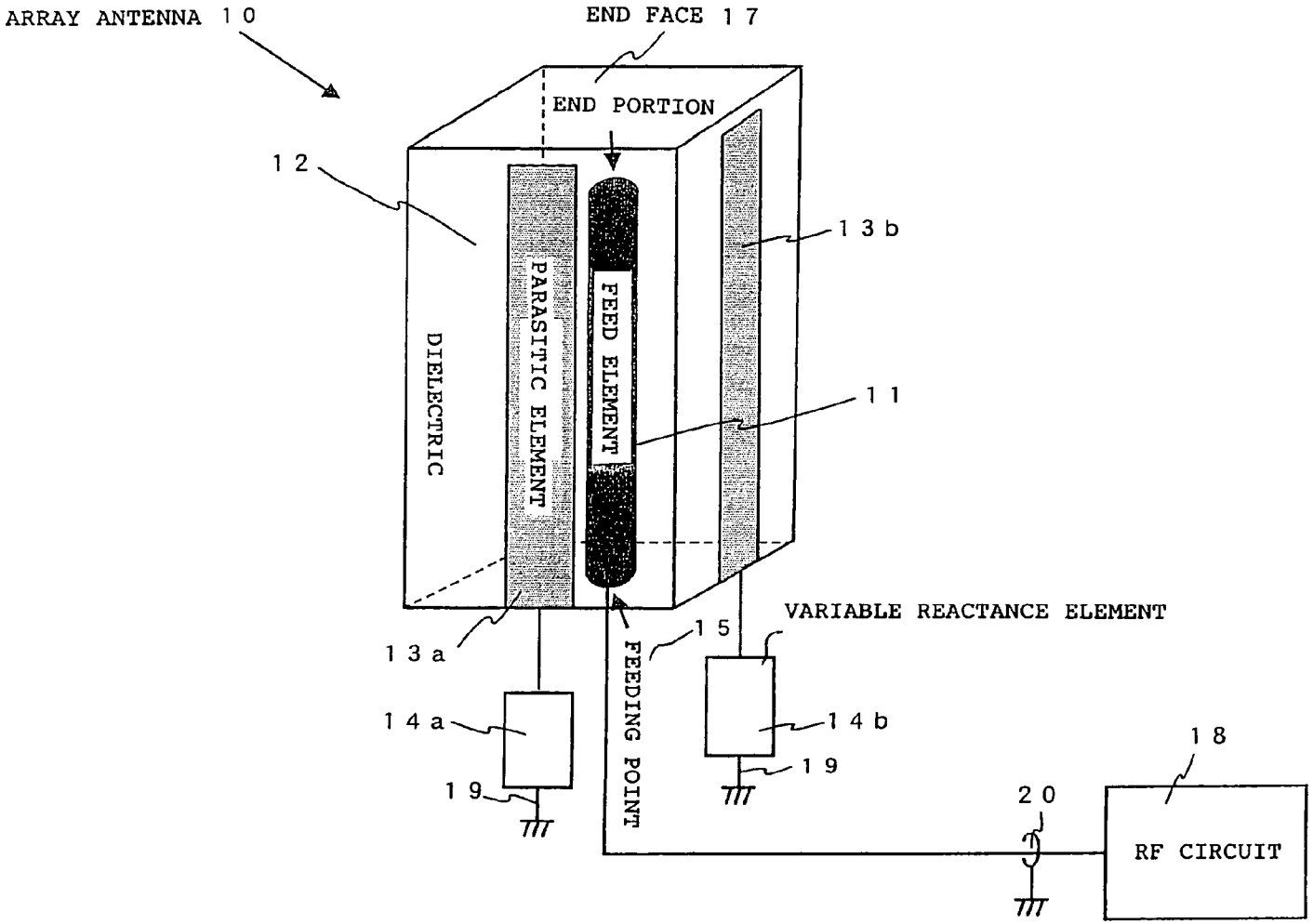
FIG. 1 is a perspective view of an embodiment of the present invention which shows the overall constitution including an array antenna.

FIG. 1 is a perspective view of a first embodiment of the present invention which shows the overall constitution which includes an array antenna. An array antenna 10, that is the dielectric antenna device according to this embodiment of the present invention, includes a dielectric 12 having a column or post shape with a square cross section. The array antenna 10 also includes a feed element 11 that is buried in the dielectric 12 along the center axis thereof which extends in the wiring direction of the dielectric 12. The array antenna 10 also includes four parasitic elements 13*a* to 13*d* which run parallel to the feed element 11 on the four sides around the center axis. The four parasitic elements sandwich at least a portion of the dielectric 12 (the parasitic elements 13*c* and 13*d* are not shown). It should be noted that the parasitic elements 13*a* to 13*d* may be buried in the dielectric 12.

The feed element 11 is a driven element that transmits or receives wireless signals. The feed element 1 is a half-wavelength monopole antenna made from an electrical conductor. The lower end of the feed element 11 forms a feeding point 15 which is connected by a coaxial cable 20 to an RF circuit 18 that supplies or receives wireless signals of 2.4 GHz or the like, for example. The end portion 16, which is the upper end of the feed element 11, extends close to the end face 17 which is the upper face of the dielectric 12. In this embodiment, the feed element 11 uses a ½ wavelength element which is different from the norm which uses a ¼ wavelength element.

The dielectric 12 is made of alumina, for example, and the dielectric constant thereof is determined by the relative permittivity $\in_r$. The overall dimension of the array antenna 10 is reduced as a result of the wavelength reduction effect. Supposing that the wavelength in a given frequency free space is $\lambda$ and the relative permittivity of the dielectric 12 is $\in_r$, then the resonance wavelength becomes approximately $\lambda/(\in_r)^{0.5}$ due to the wavelength shortening effect. If the dielectric 12 is fabricated from an alumina material, then the relative permittivity is approximately nine and there is a wavelength shortening effect, which shortens the wavelength of a given electric wave signal to approximately ⅓ from the wavelength of that electric wave signal in the free space.

Each of the parasitic elements 13*a* to 13*d* is made from an electrical conductor, and the lower ends of the parasitic elements are connected to ground, that is, ground potential 19 via variable reactance elements 14*a* to 14*d* respectively (variable reactance elements 14*c* and 14*d* are not shown). The upper ends of the parasitic elements 13*a* to 13*d* extend close to the upper face of the dielectric 12. By changing the reactance values of the variable reactance elements 14*a* to 14*d*, the parasitic elements 13*a* to 13*d* act as wave directors or reflectors and are capable of controlling the directivity of the array antenna 10.

In this embodiment, as mentioned earlier, the feed element 11 is a ½ wavelength element that differs from a normal feed element 11 which is a ¼ wavelength element. The design principles differ from the standard Yagi-Uda antenna design principles and are based on the principles of a near-field parasitic element. As a result, the respective intervals between the feed element 11 and parasitic elements 13*a* to 13*d* can be made smaller than a ¼ wavelength, whereby the size of the antenna structure can be reduced.

Figure 2C:
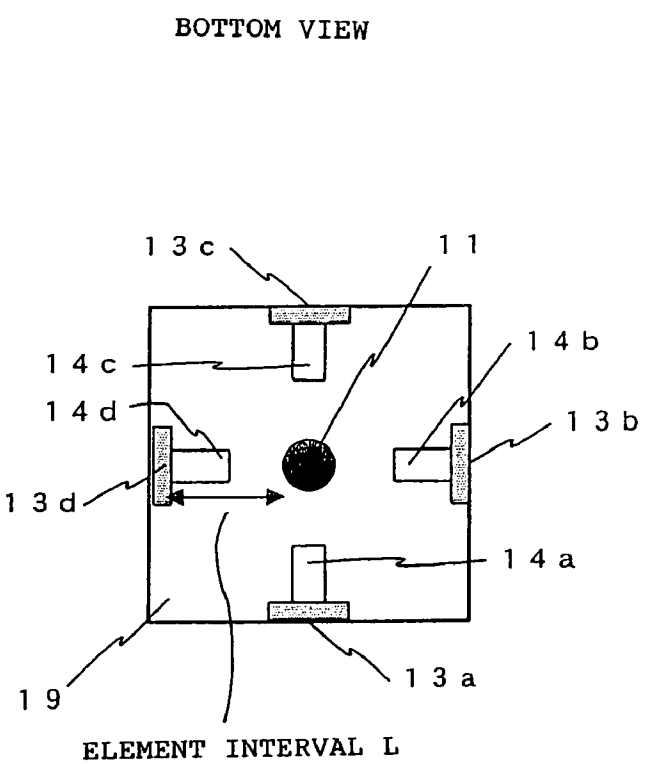
FIG. 2A to FIG. 2C illustrate the array antenna of FIG. 1 when viewed from various directions.
Figure 2B:
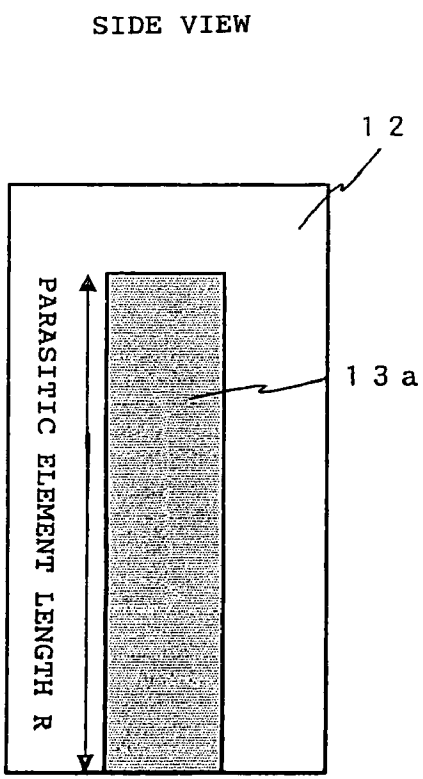
Figure 2A:
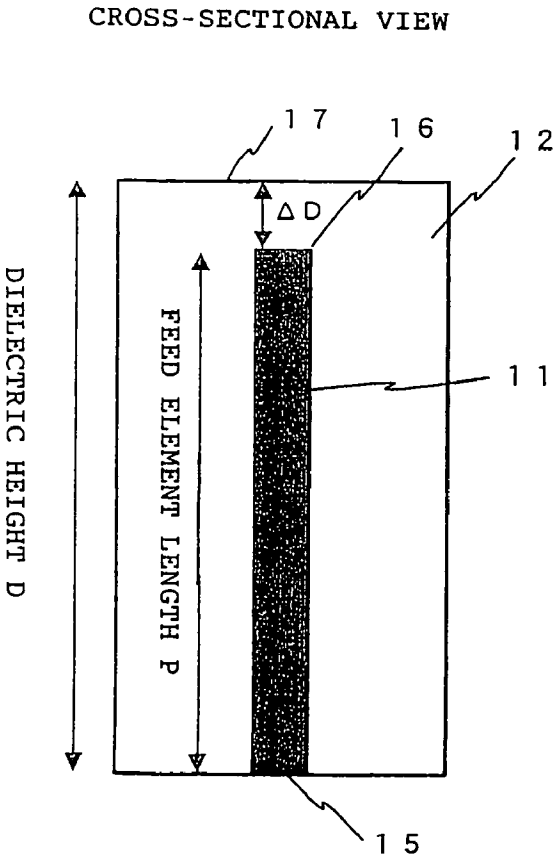

FIG. 2A to FIG. 2C illustrate the array antenna 10 of FIG. 1 when viewed from various directions. Specifically, FIG. 2A shows a cross-sectional view taken along the center axis, FIG. 2B shows a side view, and FIG. 2C shows a bottom view. The dimensions of the respective parts are also indicated.

Referring to FIG. 2A, the length of the dielectric 12 in the conducting wire direction which is contained in the array antenna 10, that is, the dielectric height D, extends a length $\Delta D$ beyond the length of the feed element 11 in the conducting wire direction, that is, the feed element length P. In other words, $\Delta D$ is a length that extends from the end portion 16 of the feed element 11 to the end face 17 of the dielectric 12. Referring to FIG. 2B, the parasitic element length R of the respective parasitic elements 13*a* to 13*d* is determined by the dielectric constant and resonance frequency of the dielectric 12. Each of the variable reactance elements 14*a* to 14*d* is provided between the associated parasitic element 13*a* to 13*d* and the ground potential 19. The parasitic elements 13*a* to 13*d* serve as ½ wavelength resonators with respect to the feed element 11 which is a ½ wavelength monopole antenna. Referring now to FIG. 2C, the interval L between the feed element 11 and the parasitic element 13*a* to 13*d* is approximately 0.1 the wavelength of a given wireless signal.

In this embodiment, the rated resonance frequency of the array antenna 10 is 2.4 GHz. The wavelength in the free space of a 2.4 GHz wireless signal is 125 mm. The antenna length of a ½ wavelength monopole antenna must be 62.5 mm if there is no wavelength shortening effect due to the dielectric. If the relative permittivity of the dielectric 12 which brings about the wavelength shortening effect is 9.7, the effective wavelength of a 2.4 GHz wireless signal formed in the dielectric 12 is approximately 40 mm. In this embodiment, the conducting wire length of the ½ wavelength monopole, that is, the feed element length P, is 18.5 mm in consideration of the effects of the interaction with the parasitic elements 13*a* to 13*d*, the thickness of the dielectric 12, and impedance matching and so forth.

The resonance frequency characteristic will now be analyzed for the array antenna shown in FIG. 1 and FIG. 2A to FIG. 2C. An electromagnetic field simulator which employs the Finite Difference Time Domain (FDTD) method was used in this analysis. The method of utilizing the electromagnetic field simulator is well-known in the art and will not be described here. The Finite Difference Time Domain method involves direct differentiation while solving Maxwell's equations which are basic equations for an electromagnetic field. Because the dielectric constant, magnetic permeability, and conductivity in the space are all contained in the coefficient of the differential expression for the respective calculation points, there is no need to especially consider the boundary conditions for which formularization is difficult. Hence, there is the benefit of being able to simplify the calculation algorithm even for a space with a discontinuous dielectric constant as per this embodiment.

As the conditions of the analysis, some different dielectric heights are used. For each of these height values, the feeding point of the feed element (the feeding point 15 shown in FIG. 1) is subjected to field excitation in the conducting wire direction (z axis) of the feed element by means of a Gaussian incident pulse, and the electric field component and magnetic field component are calculated at the respective calculation points until the Gaussian pulse reaches the upper face of the dielectric. The resonance frequency characteristic according to the dielectric height can be analyzed from the electric field ratio between the calculated peak value (Ezi) of the incident pulse and the calculated peak value (Ezd) of the transmitted pulse at the upper face of the dielectric (Ezd/Ezi). Further, the resonance characteristic can be analyzed from a frequency-dependent reflection coefficient which is obtained by subjecting the electromagnetic field component near the feeding point to a Discrete Fourier transform. The incident pulse is a Gaussian-type pulse with a half width that includes a frequency of 2.4 GHz.

Figure 3:
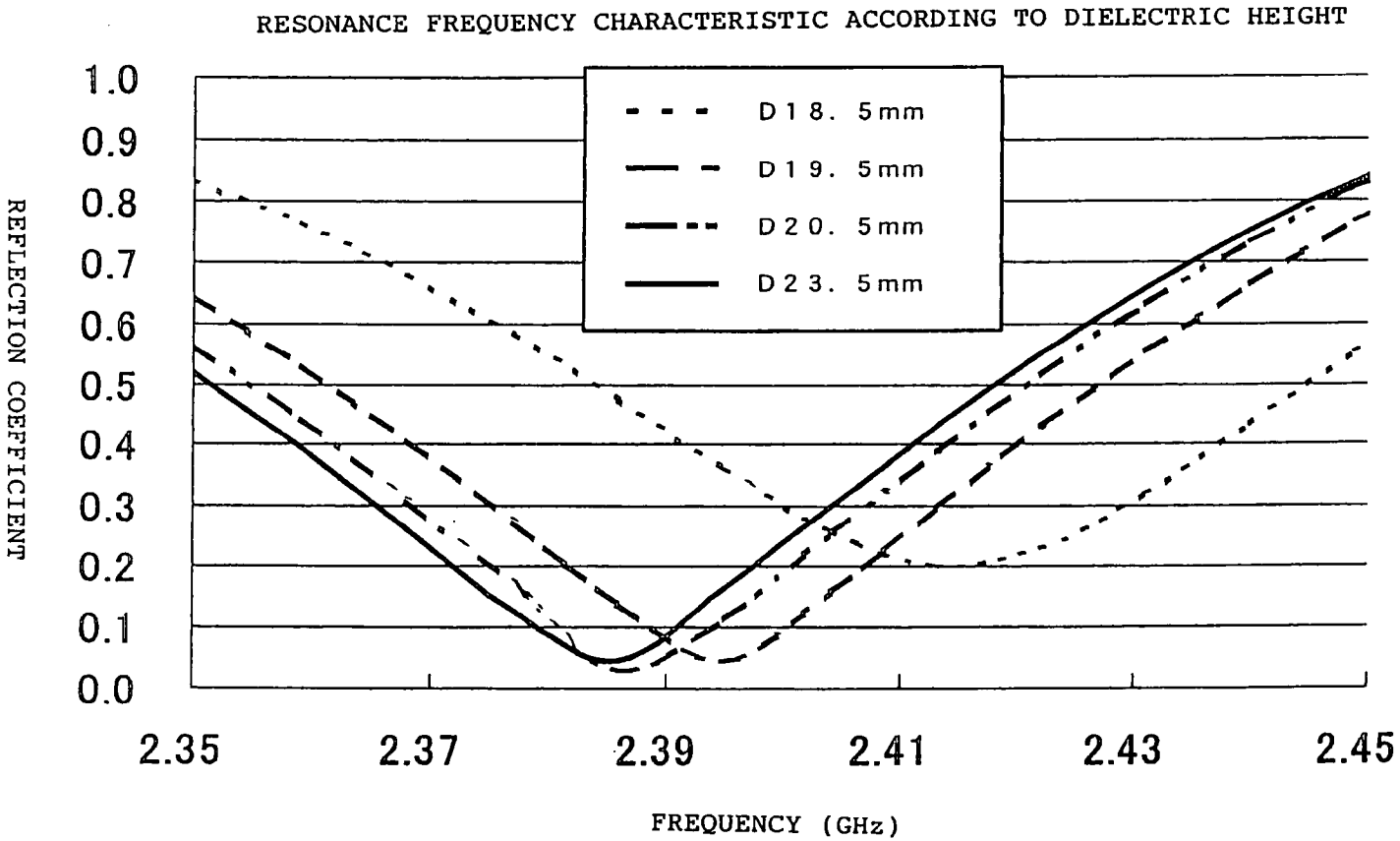
FIG. 3 is a graph which shows the resonance frequency characteristic at different dielectric heights.

FIG. 3 shows the resonance frequency characteristic of this embodiment with various dielectric heights. The resonance frequency characteristic shows the results of numerical analysis on the change in the reflection coefficient (⌈) at the feeding point with respect to a frequency variation from 2.35 GHz to 2.45 GHz. The feed element length P is 18.5 mm and the dielectric height D is in the range from 18.5 mm to 23.5 mm. The position in which the reflection coefficient (⌈) assumes the bottom value indicates the resonance frequency for the given-condition.

It can be seen from this graph that a convergence point appears at the resonance frequency when the interval ΔD between the dielectric height D and the feed element length P is equal to or more than a certain value. Specifically, it can be seen that, although the resonance point is greatly deviated when the dielectric height D is 18.5 mm, which is the same height as that of the feed element, the resonance point gradually converges close to 2.39 GHz as the dielectric height changes from 19.5 mm to 20.5 mm and is almost stable when the dielectric height falls within the range from 20.5 mm to 23.5 mm.

Figure 4:
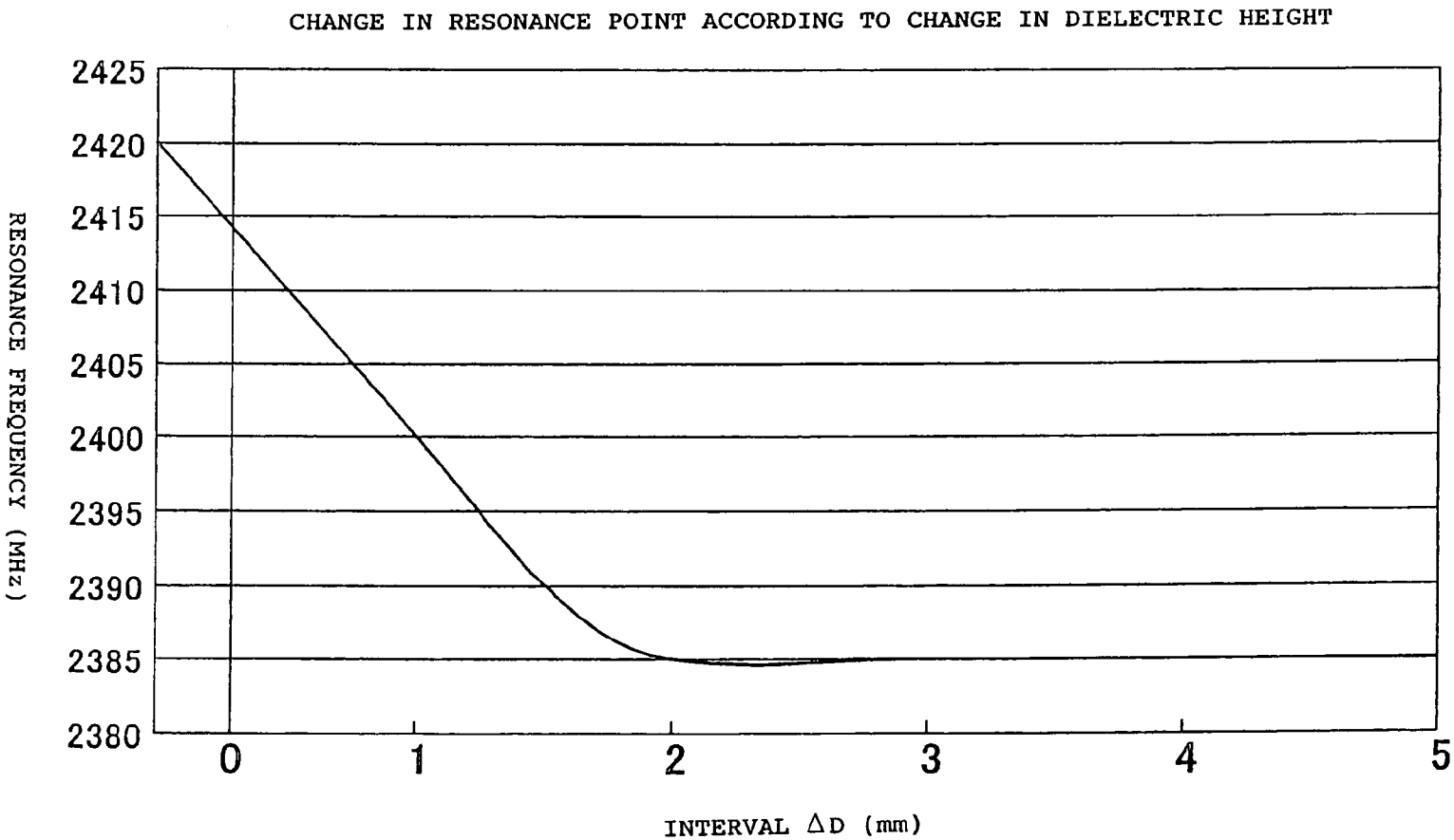
FIG. 4 is a graph showing the change in the resonance point with the dielectric height.

FIG. 4 shows the variation in the resonance point due to a change in the dielectric height. The horizontal axis represents the value of the interval ΔD between the dielectric height D and the feed element length P in the range from 0 mm to 5 mm and the vertical axis represents the resonance frequency in the range from 2380 MHz to 2425 MHz. This graph shows specifically which value of the dielectric height affords resonance point convergence. Specifically, it can be seen that the resonance point converges on 2385 MHz in cases where the value of the interval ΔD is 2 mm or more. The value of 2 mm corresponds to 1/20 of the effective wavelength 40 mm of a 2.4 GHz wireless signal in the dielectric 12. Therefore, if this result is extended to an arbitrary frequency and an arbitrary dielectric, it is suggested that the value of ΔD should be approximately 1/20 or more of the effective wavelength of a given electric wave signal in the dielectric.

As a result of the above analysis, it is clear that making the height of the dielectric equal to or more than the length (height) of the feed element contributes to the stabilization of the resonance frequency. Next, the cause of this result and the generalized conditions affording resonance frequency stabilization will be examined below.

Figures 5A, 5B:
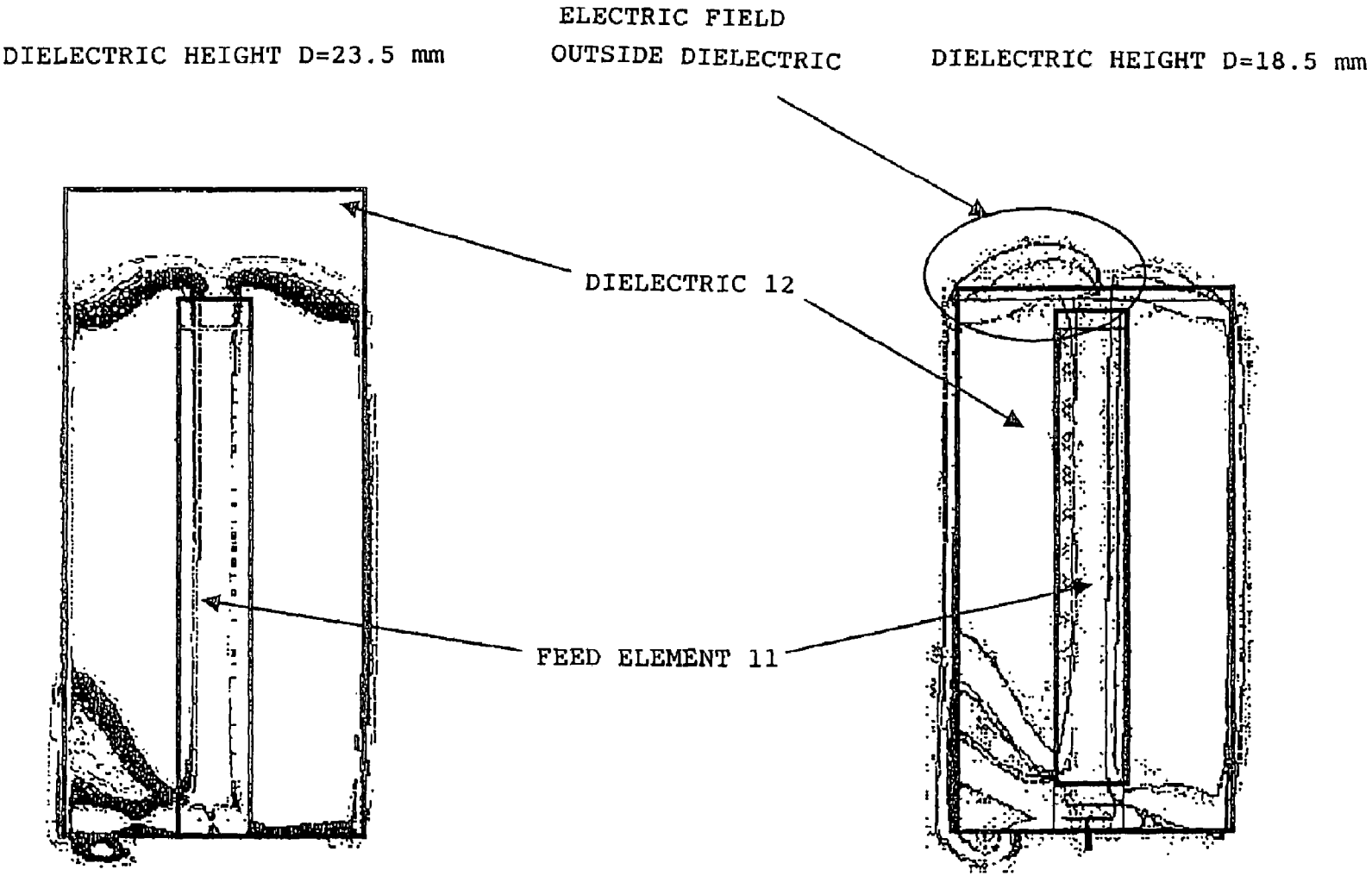
FIG. 5A and FIG. 5B show the electric field strength distribution in and around the dielectric.

FIG. 5A and FIG. 5B show the electromagnetic field distribution at different dielectric heights in the form of an image. The electric field strength (intensity) distribution in the plane passing through the center axis of the feed element is represented using white and black. The external part at which the electric field strength (intensity) is low is represented in black. The image of FIG. 5A on the left side of the drawing sheet represents a case where the dielectric height D is 23.5 mm and the image of FIG. 5B on the right side of the drawing sheet represents a case where the dielectric height D is 18.5 mm.

Referring to FIG. 5A and FIG. 5B, if the dielectric height is 18.5 mm, that is, if the dielectric height is substantially the same as the feed element length, the resonance state may be considered to be unstable because electromagnetic waves that have been transmitted through the feed element leak out of the dielectric. In contrast, if the dielectric height is 23.5 mm, the electromagnetic waves are inside the dielectric and do not leak from the top to the outside. The resonance state can be maintained and considered stable.

When the results obtained in FIG. 3 to FIG. 5B are considered, it can be said that the current value is not 0 at the upper end portion 16 of the feed element if the feed element length P is adjusted such that the electromagnetic waves that are transmitted as a result of the interaction between the feed element 11 and parasitic elements 13 achieve impedance matching. Because electromagnetic waves leak from the upper end face 17 of the dielectric 12, it is considered that this leakage has the primary effect of rendering the resonance frequency unstable. Hence, extending the height D of the dielectric 12 beyond the feed element length P by a suitable amount ΔD can stabilize the resonance frequency because such a dielectric height can keep or confine the electromagnetic field distribution within the dielectric 12 and electromagnetic waves do not leak from the end face 17 of the dielectric 12.

Figure 6:
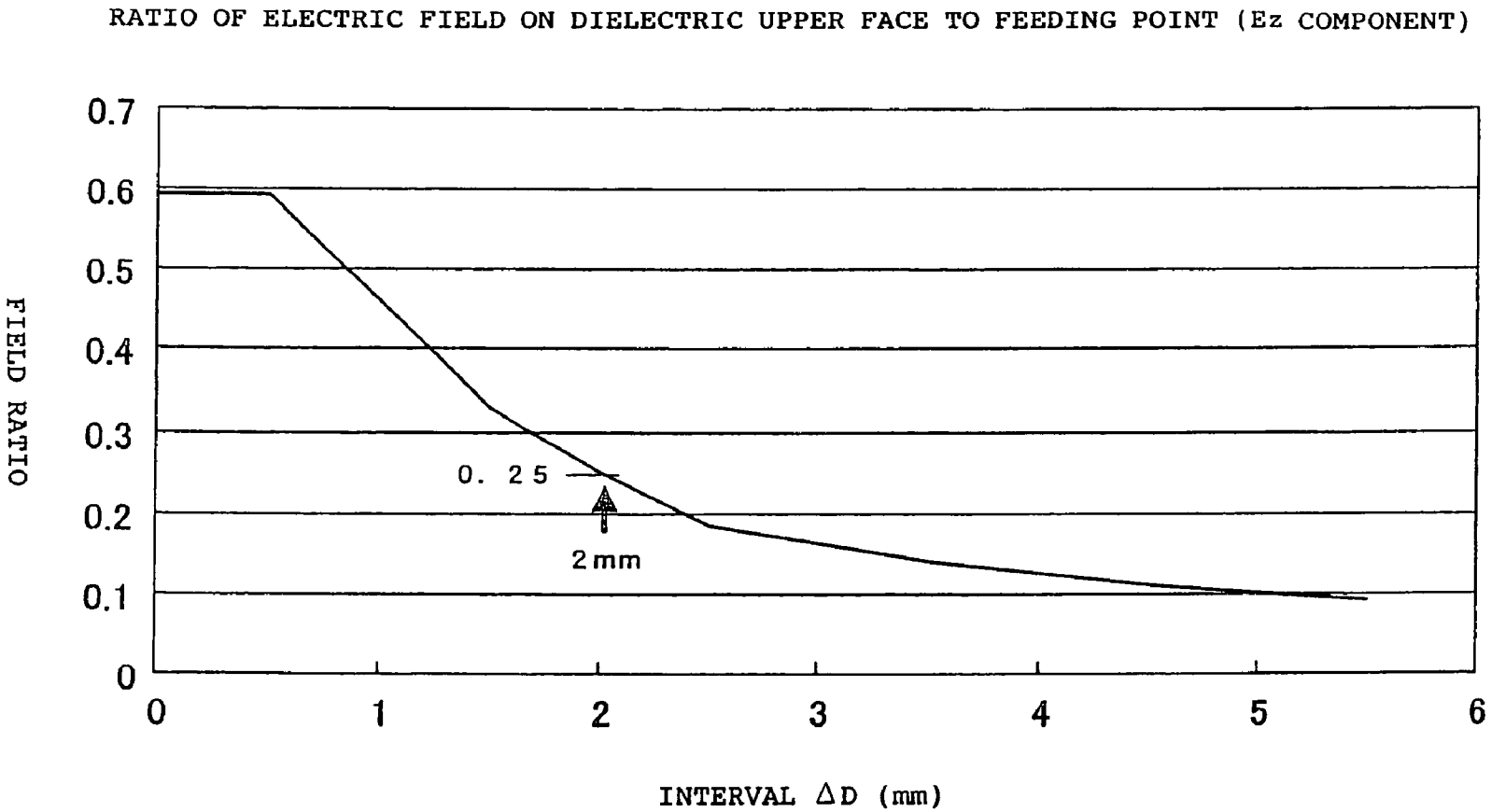
FIG. 6 is a graph showing the ratio of the electric field strength at the upper surface of the dielectric to the electric field strength at the feeding point.

FIG. 6 shows the ratio of the electric field at the dielectric upper face to the electric field at the feeding point. The horizontal axis represents ΔD (the dielectric height D−the feed element length P) and the vertical axis represents the electric field ratio between the excitation field strength at the feeding point and the end-face field strength at the dielectric upper face. Because ΔD that is equal to or more than 2 mm is required in order to adequately keep the electromagnetic field distribution within the dielectric to the extent required to stabilize the resonance frequency according to the above considerations, an electric field ratio of 0.25 which corresponds to ΔD=2 mm (approximately −6 dB) is obtained from FIG. 6. In other words, a conditional equation for obtaining the resonance frequency stabilization, $|Ezd/Ezi|<0.25$, is empirically observed for the ratio between the excitation field strength Ezi and the field strength Ezd at the end face of the dielectric. By implementing a dielectric antenna device that satisfies this conditional equation, frequency stabilization is also achieved in the case of a dielectric with an arbitrary frequency and an arbitrary dielectric constant.

The above considerations clarified the relationship between the length of the dielectric and the length of the feed element. Specifically, it can be said that a resonance frequency is stabilized by extending the dielectric in the conducting wire direction with respect to the feed element to keep the electromagnetic field distribution within the dielectric. Based on this consideration, by selecting a suitable dielectric size, which is obtained by adding a margin to the feed element length determined from the frequency to be emitted and the dielectric constant of a given dielectric, the antenna characteristic stabilizes without the resonance frequency changing even if there is a damage to the dielectric. Based on the premise that the feed element has the stabilized resonance frequency, the effect of the parasitic elements can be evaluated more accurately if a suitable interval L between the feed element and the parasitic elements is found.

In summary, the prior art does not provide a clear solution to the problem of resonance frequency fluctuations that are dependent on a dielectric size variation because of the absence of an adequate theoretical examination on the cause of the problem. For example, one conventional approach is to simply align the length of the dielectric with the end of the feed element and another conventional approach is to simply increase the size of the dielectric slightly with the object of alleviating the discontinuity of the dielectric constant. Specific countermeasures with the object of achieving the stabilization of the resonance frequency have not been known in the art. The present invention provides specific countermeasures to this problem.

Although the shape of the dielectric is a quadrangular prism or rectangular parallelepiped in the above-described embodiment, the dielectric shape may be a polyhedron or a cylinder. By using a polyhedron or a cylinder, more parasitic elements can be mounted and the antenna can be rendered multi-directional.

INDUSTRIAL APPLICABILITY

The dielectric antenna device of the present invention can be applied to an antenna that is provided in a mobile terminal, a car navigation system, and an indoor antenna. The dielectric antenna device of the present invention is not limited to an array antenna described in the embodiment, but can also be applied to a monopole or dipole antenna of wavelength n/m (where n and m are positive integers) such as a ¼ wavelength or ½ wavelength. The number of feed elements which are driven element is not limited to one, but may two or more.

What is claimed is:

1. A dielectric antenna device having at least one feed element that is buried in a dielectric, wherein an interval between an end portion of the feed element and an end face of the dielectric in a direction passing through the end portion of the feed element from a feeding point thereof is substantially 1/20 or more of a wavelength of a wireless signal that is formed within the dielectric.

2. The dielectric antenna device according to claim 1, wherein a field strength at the end face of the dielectric is no more than substantially ¼ of a field strength at the feeding point of the feed element.

3. The dielectric antenna device according to claim 1, wherein the feed element comprises a ¼ or ½ wavelength element.

4. The dielectric antenna device according to claim 1, further comprising at least one parasitic element that is buried in the dielectric or attached to the dielectric with at least a part of the dielectric interposed between the feed element and the parasitic element.

5. The dielectric antenna device according to claim 4, wherein an interval between the feed element and the parasitic element is no more than substantially 1/10 of the wavelength in the dielectric.

6. The dielectric antenna device according to claim 4, wherein one end of the parasitic element is connected to a variable reactance element.

7. The dielectric antenna device according to claim 1, wherein the dielectric has a cylindrical shape or a column shape of a polygonal cross section, and the feed element extends along a center axis of the dielectric.

* * * * *